United States Patent [19]

Pierce, Jr.

[11] Patent Number: 5,029,594

[45] Date of Patent: Jul. 9, 1991

[54] SYSTEM FOR CLEANING WHIRLPOOL BATHS

[76] Inventor: Joseph B. Pierce, Jr., 1811 Old Shell Rd., Mobile, Ala. 36607

[21] Appl. No.: 465,471

[22] Filed: Jan. 16, 1990

Related U.S. Application Data

[63] Continuation-in-part of Ser. No. 243,278, Sep. 12, 1988, Pat. No. 4,919,160.

[51] Int. Cl.[5] ..... B08B 9/02

[52] U.S. Cl. ..... 134/100; 134/113; 134/166 C

[58] Field of Search ..... 4/490, 542, 543, 544; 134/93, 100, 113, 166 R, 166 C, 169 R, 169 C, 169 A; 239/112, 113, 310, 318

[56] References Cited

U.S. PATENT DOCUMENTS

| | | | |
|---|---|---|---|
| 2,785,012 | 3/1957 | Frewin | 239/318 X |
| 2,910,075 | 10/1959 | Federighi et al. | 134/100 X |
| 3,139,890 | 7/1964 | Moran | 134/100 |
| 3,484,811 | 12/1969 | Weihe, Jr. | 134/100 X |
| 3,961,382 | 6/1976 | Peterson, Jr. | 4/544 X |
| 4,383,341 | 5/1983 | Altman | 4/490 X |
| 4,563,781 | 1/1986 | James | 4/544 X |

*Primary Examiner*—Philip R. Coe

*Attorney, Agent, or Firm*—Pravel, Gambrell, Hewitt, Kimball & Krieger

[57] ABSTRACT

What is provided is a water line connected onto the outflow end of the whirlpool bath; a source of pressurized water, for example from a hose connected onto the second end of the flowline, so that introduction of water from the hose introduces the water into the line and up through the outflow pipe into the pump which in turn would be expelled from the intake ports around the base of the mechanism; a valving means at the end of the flow line, in order to reduce the pressure of the fluid flow to avoid movement of the fluid into the motor assembly adjacent the juncture of the flow line and the flow pipe; a second line forming a juncture with the fluid line, the second line capable of adapting a volume of cleaning solution thereunto, so that upon introduction of fluid into the line from the hose, the cleaning solution may in turn be introduced into the flow of the water into the mechanism to provide a cleaning solution or disinfectant through the mechanism; a second valving member means for controlling the amount of flow of cleaning solution or disinfectant into the fluid flow line; and a means for measuring a quantity of disinfectant being introduced into the line per unit volume of water being introduced thereinto.

9 Claims, 3 Drawing Sheets

SYSTEM FOR CLEANING WHIRLPOOL BATHS

This is a continuation-in-part of U.S. patent application Ser. No. 243,278 entitled "System For Cleaning Whirlpool Baths", filed on Sept. 12, 1988 by inventor Joseph B. Pierce, fully incorporated by reference thereto and now U.S. Pat. No. 4,919,160.

BACKGROUND OF THE INVENTION

1. Field of the Invention

The system of the present invention relates to whirlpool baths. More particularly, the present invention relates to a system for flushing fluids through the mechanism of a whirlpool bath in order to disinfect, clean, or flush the system.

2. General Background

Whirlpool baths are used extensively in the treatment of injured or ill patients, as a therapeutic device. In general, a whirlpool bath allows a patient to submerge the injured portion of his body into a tank filled with a certain quantity of water, and the mechanism of the bath draws water up into a pump mechanism to be exited under certain force, so to provide a swirling motion of hot fluid around the injured part, which is known to help reduce swelling, or infection, or perhaps clean open wounds of a patient.

One of the overriding concerns in the use of whirlpool baths, is the assurance that the whirlpool bath is completely clean after use of the bath by a particular patient. In the cleaning of the tank portion of the bath, the tank portion or the outer mechanism is simply rubbed or scrubbed down with a disinfectant or the like, to assure that all germs left in the outer mechanism or tank have been removed so that the next patient may use the mechanism in a clean manner. However, an overriding concern is the cleaning of the internal mechanism i.e., the intake pipe, the pump mechanism and the outflow pipe, which cannot be cleaned with a type of "scrub-down", and must have fluids flushed therethrough. Therefore, in the present state of the art, this is accomplished by filling the tank with a level of water above the intake port, placing a disinfectant in the water, and turning the bath on so that the water is circulated through the pipes to the intake pipe to pump in the outflow pipe, thereby cleaning them. However, this particular method of cleaning is often expensive and time consuming due to the fact that the water volume, particularly in the large tanks, is quite great, and which must be therefore removed after the cleaning is complete. Another type of method is to submerge the intake pipe into a "container" of water containing disinfectant and undertaking the same type of flow through the system. Again, this process of having to fill the container with water inserted into the tank and place the mechanism thereinto also is quite time consuming and inefficient.

The following patents have been found in the search conducted of the art and may be pertinent to the present invention:

| U.S. PAT. NO. | INVENTORS | DATE |
|---|---|---|
| 831,722 | H. J. HOLMES | Sept. 25, 1906 |
| 1,941,065 | S. WILLIAMSON | Dec. 26, 1933 |
| 1,605,749 | W. H. McCARTHY | Nov. 2, 1926 |
| 4,321,712 | DIXON | March 30, 1982 |
| 2,267,064 | E. WIKELUND | Dec. 23, 1941 |
| 3,936,892 | MILLER | Feb. 10, 1976 |

-continued

| U.S. PAT. NO. | INVENTORS | DATE |
|---|---|---|
| 4,371,991 | SCHROTT | Feb. 8, 1983 |

This invention constitutes an improvement over Applicant's pending application Ser. No. 243,278 filed on Sept. 12, 1988 entitled "System For Cleaning Whirlpool Baths", which is incorporated by reference thereto. This improvement would solve the problem of reducing the pressure of the water being introduced into the system, in order to avoid the water under high pressure from moving into the housing area, and making contact with the motor assembly.

SUMMARY OF THE PRESENT INVENTION

The system of the present invention solves the problem of the cleansing of whirlpool baths, as disclosed in U.S. Ser. No. 243,278 filed on Sept. 12, 1988, in a simple and straightforward manner. What is provided is a water line connected onto the outflow end of the whirlpool bath; a source of pressurized water, for example from a hose connected onto the second end of the flowline, so that introduction of water from the hose introduces the water into the line and up through the outflow pipe into the pump which in turn would be expelled from the intake ports around the base of the mechanism; a valving means intermediate the flow line, and the outflow pipe of the whirlpool bath, in order to regulate the pressure of the fluid flow to avoid movement of the fluid into the motor assembly adjacent the juncture of the flow line and the flow pipe; a second line forming a juncture with the fluid line, the second line capable of adapting a volume of cleaning solution thereunto, so that upon introduction of fluid into the line from the hose, the cleaning solution may in turn be introduced into the flow of the water into the mechanism to provide a cleaning solution or disinfectant through the mechanism; a second valving member means for controlling the amount of flow of cleaning solution or disinfectant into the fluid flow line; and a means for measuring a quantity of disinfectant being introduced into the line per unit volume of water being introduced thereinto.

Therefore, it is the principal object of the present invention to provide a system for flowing water containing cleaning solution through the mechanism of a whirlpool bath in order to clean the internal mechanism of the bath;

It is still a further principal object of the present invention to provide a system which attaches to the outflow end of the whirlpool bath, and forces cleaning fluid and water into the outflow pipe, through the pump, and down out through the intake port of the bath in the reverse action that a whirlpool bath would operate, therefore cleaning the internal mechanism;

It is a further principal object of the present invention to provide the system for cleaning a whirlpool bath, by regulating the cleaning fluid and water flowing into the outflow pipe from a flowline, so as to avoid movement of the fluid into the motor assembly of the whirl pool bath; and It is the further object of the present invention to provide a cleaning system for a whirlpool bath, which while introducing a flow of water into the interval mechanism of the bath, simultaneously introduces a volume of cleaning solution or disinfectant into the water flow for disinfecting or cleaning the internal mechanism as the water flows therethrough.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

FIGS. 1–4 illustrate the preferred embodiment of the system of the present invention by the numeral 10.

Figure 1:
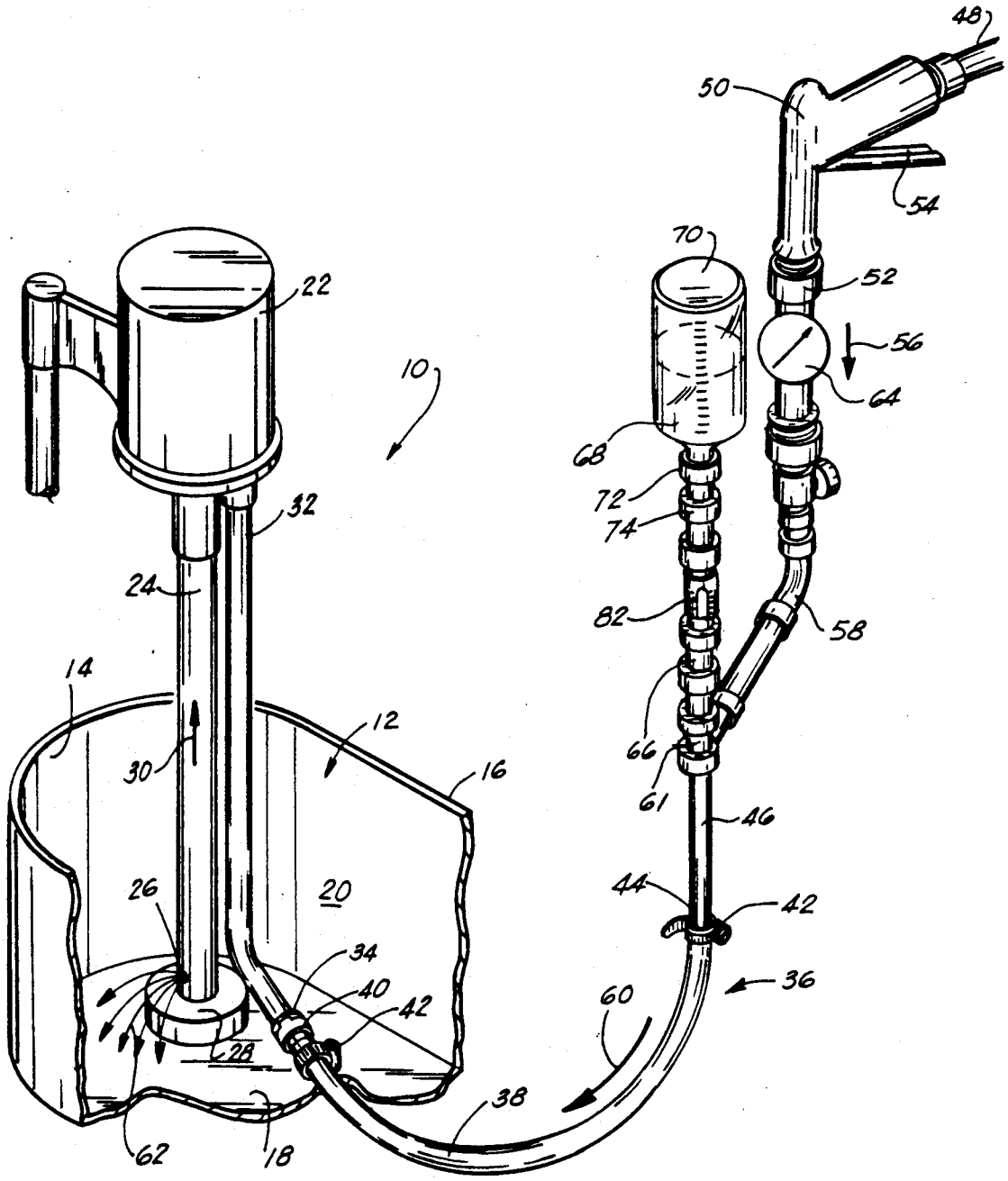
FIG. 1 is an overall view of the preferred embodiment of the system of the present invention.

As seen in FIG. 1, system 10 would be utilized in conjunction with a standard whirlpool bath 12 the whirlpool bath comprising a tank portion 14 (as seen in partial view) constructed of a continuous sidewall 16 and a bottom portion 18, a continuous sidewall 16 and bottom portion 18 defining the interior 20 of the bath for use by a patient in therapy. As seen further whirlpool bath 12 would include a pump 22 mounted atop an intake 24 whereby water contained within tank portion 20 would be pumped into intake pipe 24 via intake port 26, located on foot portion 28 resting on the floor 18 of tank portion 14. The water in its normal use would flow in the direction of arrow 30 up intake pipe 24 through pump 22 and out of outflow pipe 32 under pressure to flow out of the end portion 34 of outflow line 32 into tank portion 20 for creating a whirlpool action within the water in the whirlpool for use during therapy.

System 10 as illustrated in the FIGURES, would be utilized as a means for cleaning the internal mechanism of intake pipe 24, pump 22 and outflow pipe 32 in the system of the present invention. What would be provided is a means 36 for introducing fluid into the outflow pipe 32 in the following manner. It should be noted at this point, that a system of the present invention would undertake cleaning action through the internal mechanism of the whirlpool bath in the opposite direction that the fluid flow in the bath under normal use would take. That is, as seen, cleaning means 36 would include a fluid line 38 provided with a quick coupling 40 which is adaptable to engage onto the end 34 of outflow pipe 32. There could be provided for example a screw clamp 42 for insuring the seal between end 34 and end 40 is fluid tight. The second end of fluid line 38 again would be coupled via a screw clamp 42 to an end portion 44 of line 46 which would deliver fluid from a fluid source, such as a hose 48 in the present system of the present invention. Hose 48 would be adaptable with a nozzle, for example 50, which would be threadably engaged into a coupling 52, so that upon squeezing of handle 54 on nozzle 50, water would flow in the direction of arrow 56 through line 58 which would then be introduced into line 46 at point 61, so that the fluid flow would continue in the direction of arrows 60 up through outflow line 32 pump 22 and out and down intake line 24 to be exited from intake port 26 in the direction of arrows 62.

Therefore, in order to flush for example pure water through the system, one would simply introduce water from hose 48 through the line to flush the system. Line 58 would further include a valve 75 which may be moved between "open" and "closed" positions to regulate the "on" "off" flow of water or the amount of water flowing through line 58 into principal line 38.

Further, the system would include a secondary line 66 which would be utilizing the means for introducing a volume of disinfectant or cleaning fluid 68 which would be contained in a vessel 70 as seen in the FIGURE. Vessel 70 would be attached in an inverted position via a mouth portion 72 to the upper end 74 of line 66, and would therefore allow fluid flow via gravity to flow into line 66 and then would be joined by the flow of fluid through line 58 into common line 46 and introduce the disinfectant into the water flow through the system. Like line 58, line 66 is likewise provided with a valve 75 (see FIG. 2) which is movable between "open" and "close" positions for allowing fluid flow from vessel 70 into line 66 during the operation.

Further, as seen in FIG. 1 there is a means 80 contained within flow line 66 for measuring the quantity of fluid from vessel 70 that will be introduced into the fluid line 46.

Figure 1A:
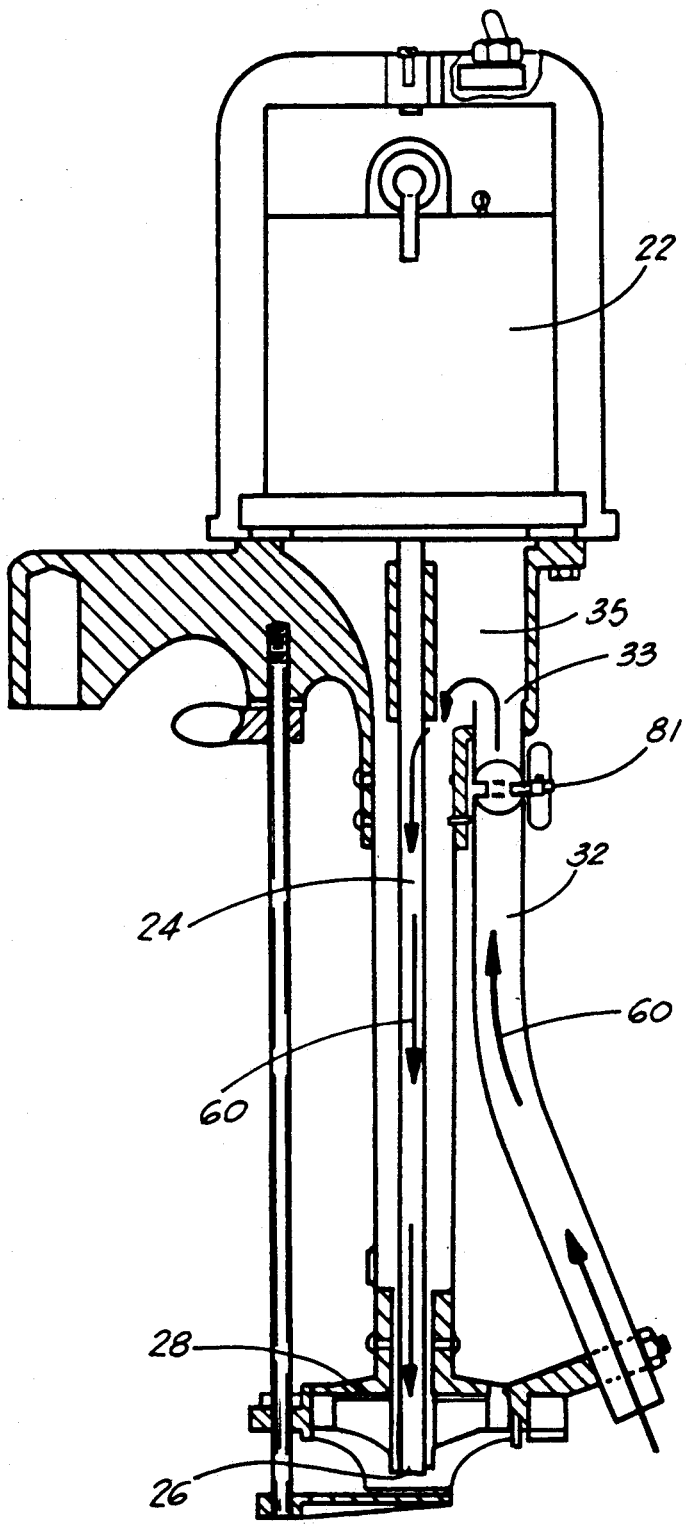
FIG. 1A is a cross section view of the preferred embodiment of the system of the present invention.

Turning now to FIG. 1A, there is illustrated in cross section view, a portion of outflow pipe 32, which has received the pressurized fluid which is being introduced in the direction of line 60, to the upper end point 33 of outflow pipe 32 as illustrated. At that point, the pressurized flow would flow downward into whirlpool intake line 24, and would travel downward to the base 28 of line 24, to be expelled through ports 26 in the cleansing process. As is further illustrated, the upper end 33 of outflow pipe 32 defines a receiving chamber 35, which is interconnecting flow pipes 32, and motorized pump 22.

Figure 2:
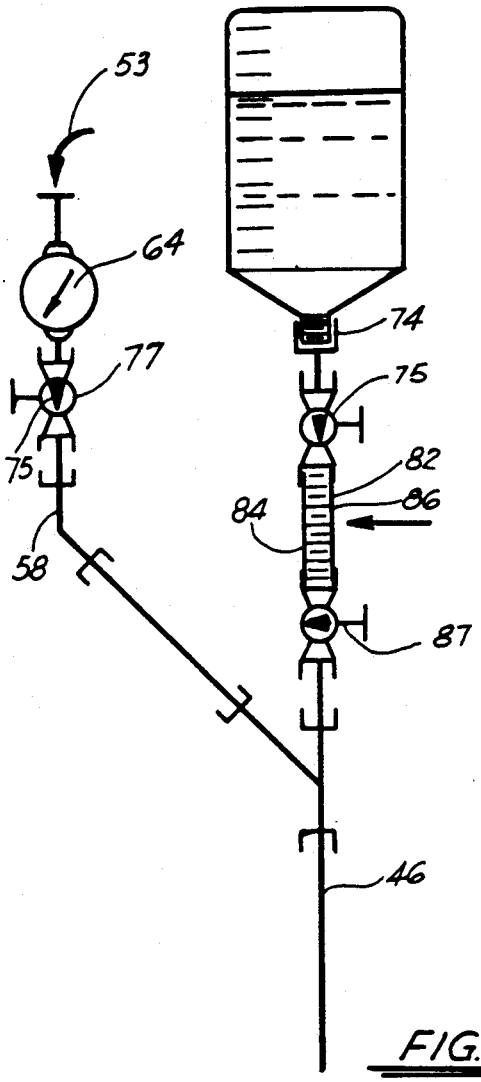
FIGS. 2 and 3 illustrate representational views of the fluid introduction portion in the system of the preferred embodiment of the system of the present invention.
Figure 3:
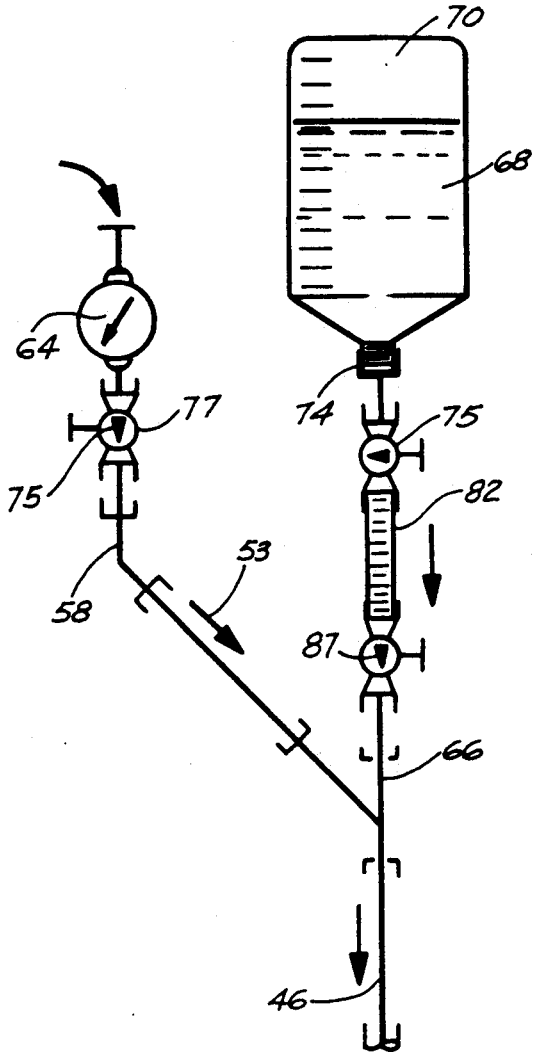

In the original system, valve 73, served as a means for regulating the flow of fluid into line 58 as seen in FIGS. 1 through 3. However, it has been found that there is needed a pressure reduction valve 64 incorporated into the system directly above valve 73, in order to reduce the pressure of the water that is flowing into valve 75. For example, as seen in FIG. 1, due to the fact that the pressure of the water in hose 48 moving into line 58 is at a great amount, the pressure reduction valve 64 has been incorporated at that point, so as to assure that the pressure of the water being introduced into line 58 is not so great as to cause the flow of the water to contaminate motor 22 as was discussed in regard to FIG. 1A.

FIGS. 2 and 3 illustrate representational views of the system of the present invention, there is illustrated, for example in FIG. 2 a quantity of fluid 68 contained in a vessel 70, in the inverted position, so that end portion 72 of vessel 70 is threadably engaged to the upper end 74 of line 66 for allowing fluid to flow from vessel 70 into line 66. Directly below receiving caps 74 there is included a first valve 75, which, in the "open" position as seen in FIG. 2, would allow a quantity of fluid to flow within a graduated measuring chamber 82 having a glass sidewall 84 with graduations 86 thereupon, in order to measure the exact quantity of fluid being introduced thereinto. In order to assure that the fluid is contained within measuring container 82, there is provided a second valve 87 directly below the measuring container 82, so that when fluid is allowed to flow into container 82, valve 87 is placed in the "closed" position (see FIG. 2), so that the fluid would fill the container 82 to a certain predetermined level as desired. As long as valve 87 in the "closed" position, fluid contained within container 82 would be unable to flow down line 66 in order to join the fluid flow in line 46. As seen in the FIGURE the fluid flow into line 46 would be provided through line 58 wherein a hose or the like would be threadably attached to cap 52 so that the introduction of water as seen by arrow 53 would be introduced into line 58 to flow downward into line 46 into the system. However, the flow of water through line 58 would be regulated by valve 64 so that the water could not flow near valve 64 in the "closed" position.

For example as seen in FIG. 2, the arrow 65 represented in valve 64 indicates the valves in the "open" position and therefore water flow would be enabled to go through line 58 down line 46 and into the system. Yet simultaneously valve 87 in the "closed" position and therefore fluid contained within vial 82 would be unable to flow into the flow line until valve 87 is placed in the "open" position. This is accomplished in FIG. 3. As seen in FIG. 3 the volume of fluid within the container 82 has been released therefrom due to the fact that valve 87 has been placed in the "open" position and fluid flow is allowed through line 66 to be joined with the water in line 58 down into common line 46 where a mixture of cleansing solution and water is obtained. Likewise, as seen in FIG. 3 so that no further introduction of fluid into line 66 is allowed, valve 75 is in the "closed" position thus preventing any further fluid from vessel 70 to be introduced into the graduated cylinder 82, until valve 87 is placed in the "closed" position and the amount of fluid may be measured out.

Figure 4:
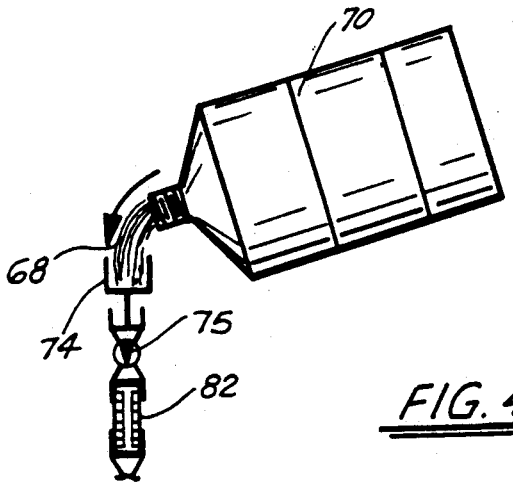
FIG. 4 illustrates an additional option in the introduction of cleaning fluid or disinfectant in the preferred embodiment of the system of the present invention.

In FIG. 4 there is illustrated an additional means of pouring fluid 68 from a vessel 70 into the system, without having to measure the amount of fluid needed. This would simply entail placing both of valves 75 and 87 in the "open" position, and once water flow is traveling through line 58 and is manually pouring fluid 68 from vessel 70 into cap 74, so the fluid may readily flow through graduated cylinder 82 to line 66 and be mixed with the water in common line 46 to be flushed with the system. Therefore, in either manner, one could either provide for a certain measured quantity of cleansing fluid into the system, or an entire vessel of fluid into the system in order to achieve a certain end in cleaning or disintfectant.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A system for cleaning whirlpool baths, comprising:
(a) a principal flow line, having a first end capable of introducing a flow of a first fluid under pressure thereinto, and a second end engageable onto a backflow line of a whirlpool bath;
(b) valving means positioned at the first end of the principal flow line for defining a means to reduce the pressure of the fluid flowing thereinto; and
(c) a secondary flow line forming a juncture with the principal flow line, the secondary flow line having an end portion for adaptably engaging a quantity of a second fluid thereinto, so that the flow of second fluid may join the flow of first fluid through the principal flow line and into the whirlpool bath and
(d) vessel means for measuring out the amount of fluid contained in the secondary fluid line to be introduced into the principal flow line.

2. The system in claim 1 further comprising a second valving means for controlling the flow of fluid both in the principal flow line and the secondary flow line to obtain a certain ratio of mixture between the fluids in the two lines.

3. The system in claim 1, wherein the second end of the principal flow line is attached to the outflow end of the whirlpool bath for flushing fluids in a reverse direction as in normal operations.

4. The system in claim 1, wherein there is further included a source of pressurized water into the first end of the principal flow line.

5. The system in claim 1, wherein the system further comprises valving means for controlling the flow of fluid both in the principal and in the secondary fluid flow lines.

6. A system for cleaning a whirlpool bath having a tank portion for containing a quantity of fluid, a fluid intake pipe, a fluid outflow pipe, and pump means for pumping fluid into the intake pipe and out of the outtake pipe into the tank portion, the system, comprising:
(a) a principal flow line, the first end of which is adapted to the end portion of the outflow pipe, and the second end of which is adapted to receive a flow of water under pressure;
(b) a first valving means positioned at the second end of the principal flow line for reducing the pressure of the flow of water into the principal flow line;
(c) a secondary flow line introduced into the first end of the principal flow line, and having a second end adaptable with a quantity of cleansing fluid in a vessel;
(d) graduated vessel means for introducing a predetermined quantity of fluid from the vessel into the graduated vessel means;
(e) second valving means for allowing the predetermined quantity of cleansing fluid to flow into the secondary flow line and advance into the principal flow line; and
(f) means for forcing the fluid in the principal flow line, containing the cleansing fluid, into the outlet pipe of the whirlpool bath, through the pump means and through the intake pipe to exit out of the intake port, in a reverse action of the normal flow of fluid in the system.

7. The system in claim 6, wherein the source of pressurized water comprises a water faucet.

8. The system in claim 6, wherein the amount of fluid introduced into the secondary line may be introduced in an unmeasured amount in the use of the system.

9. A system for cleaning a whirlpool bath of the type having a tank portion for containing a quantity of fluid, a fluid intake pipe, a fluid outflow pipe, and pump means for pumping fluid into the intake pipe and out of the outflow pipe into the tank portion, the system, comprising:
(a) a principal flow line, having first and second ends, the first end connected to an end portion of the outflow pipe, and the second end of the principal flow line adapted for receiving a flow of pressurized fluid thereinto;
(b) valving means at the juncture of the principal flow line and the outflow pipe in order to reduce the pressure of the fluid flowing into the outflow pipe so that the fluid does not make contact with the pump means;

(c) a secondary flow line joining the first end of the principal flow line, and having a second end adaptable for receiving a quantity of cleansing fluid in a vessel;

(d) second valving means for allowing a premeasured quantity of cleaning fluid to flow into the secondary flow line and advance into the principal flow line; and (e) means for forcing the fluid in the principal flow line, containing the cleansing fluid, into the outlet pipe of the whirlpool bath, through the pump means and through the intake pipe to exit out of the intake port, in a reverse action of the normal flow of fluid in the system.

* * * * *